US005839257A

United States Patent [19]

Soderstrom et al.

[11] Patent Number: 5,839,257

[45] Date of Patent: Nov. 24, 1998

[54] DRUG PACKAGING MACHINE

[75] Inventors: Jan Soderstrom; David A. Shultz, both of Buffalo Grove, Ill.; Shinichi Honda, Toyonaka, Japan; Hiroyasu Hamada, Toyonaka, Japan; Ryuji Kitai, Toyonaka, Japan

[73] Assignees: AutoMed Technologies Incorporated, Buffalo Grove, Ill.; Kabushiki Kaisha Yuyama Seisakusho, Toyonaka, Japan

[21] Appl. No.: 845,237

[22] Filed: Apr. 21, 1997

[30] Foreign Application Priority Data

Apr. 22, 1996 [JP] Japan ..... 8-100407

[51] Int. Cl.[6] ..... B65B 61/02; B65B 9/06

[52] U.S. Cl. ..... 53/411; 53/450; 53/168; 53/550; 53/131.5

[58] Field of Search ..... 53/131.5, 168, 53/550, 562, 411, 450

[56] References Cited

U.S. PATENT DOCUMENTS

| | | | |
|---|---|---|---|
| 4,655,026 | 4/1987 | Wigoda | 53/131.5 X |
| 4,972,657 | 11/1990 | McKee | 53/168 X |
| 5,502,944 | 4/1996 | Kraft et al. | 53/168 X |
| 5,678,393 | 10/1997 | Yuyama et al. | 53/168 X |

*Primary Examiner*—Linda Johnson

*Attorney, Agent, or Firm*—Wenderoth, Lind & Ponack, L.L.P.

[57] ABSTRACT

A drug packaging machine which can provide patients with information of any drug which cannot be packaged in a drug bag if prescribed drugs include such a drug. If prescribed drugs include a drug which cannot be packaged in a drug bag, an empty bag is formed at a position corresponding to the order in which this particular drug is to be taken, and the data for taking this particular drug is printed on the empty bag. A patient can thus take all of his or her necessary drugs simply by following the order in which the drug bags are series-connected.

4 Claims, 8 Drawing Sheets

* M.N.E and B are abbreviations for morning, noon, evening and before going to bed, respectively.

DRUG PACKAGING MACHINE

BACKGROUND OF THE INVENTION

This invention relates to a drug packaging machine for packaging drugs in drug bags formed by sealing a strip of sheet according to the prescription.

Examined Japanese Patent Publication 3-35181 discloses a drug packaging machine of this type. As shown in FIG. 8, it puts drugs prescribed for each patient in a strip of series-connected drug bags 5 in small bag sections, and prints, on each drug bag, the patient's name, the kind and amount of drugs in the bag, taking time and other necessary data.

At the head of the strip 20 of drug bags for each patient, a label 21 is attached that displays prescription data.

Frequently, prescriptions designate drugs which cannot be put in drug bags, such as wet packs, liquid drugs or drugs for instillation.

If a prescription contains data on drugs which cannot be put in drug pouches, conventional drug packaging machines simply ignore these data. That is, they select only drugs which can be put in bags 5, put them in bags, and print data on these drugs and the taking directions on the bags.

For hospitals, it would be desirable to print, besides prescribed drug data, such data as hospital names and phone numbers, examination dates and times, hospital advertisements, and billing data including the total billed amount and its breakdown, on drug bag strips 20.

An object of this invention is to provide a drug packaging machine which provides patients with information on a drug or two which cannot be put in drug bags if prescribed drugs include such drugs.

SUMMARY OF THE INVENTION

According to this invention, if prescribed drugs include a drug which cannot be put in a drug bag, an empty drug bag is formed at a position corresponding to the order in which the drug which cannot be put in a drug bag is to be taken, and taking data for the drug which cannot be put in a drug bag is printed on the empty bag.

Also, one or more than one of a plurality of drugs bags may be empty bags on which are printed data on advertisements and/or billing data.

The drug packaging machine according to this invention prints taking data on drug bags that actually contain prescription drugs. For any drug that cannot be put in a bag, the packaging machine forms an empty bag at a position corresponding to the order in which this drug is to be taken and prints taking data for this particular drug on the empty bag. The strip of bags thus formed includes all the necessary information for the drugs, including the drug which cannot be put in a bag. Thus, a patient can see the taking schedule of all of his or her drugs at a glance.

Advertisement data and billing data printed on empty ones of the plurality of series-connected drug bags will be a convenient source of general information for patients.

Other features and objects of the present invention will become apparent from the following description made with reference to the accompanying drawings, in which:

DETAILED DESCRIPTION OF THE PREFERRED EMBODIMENT

Figure 1:
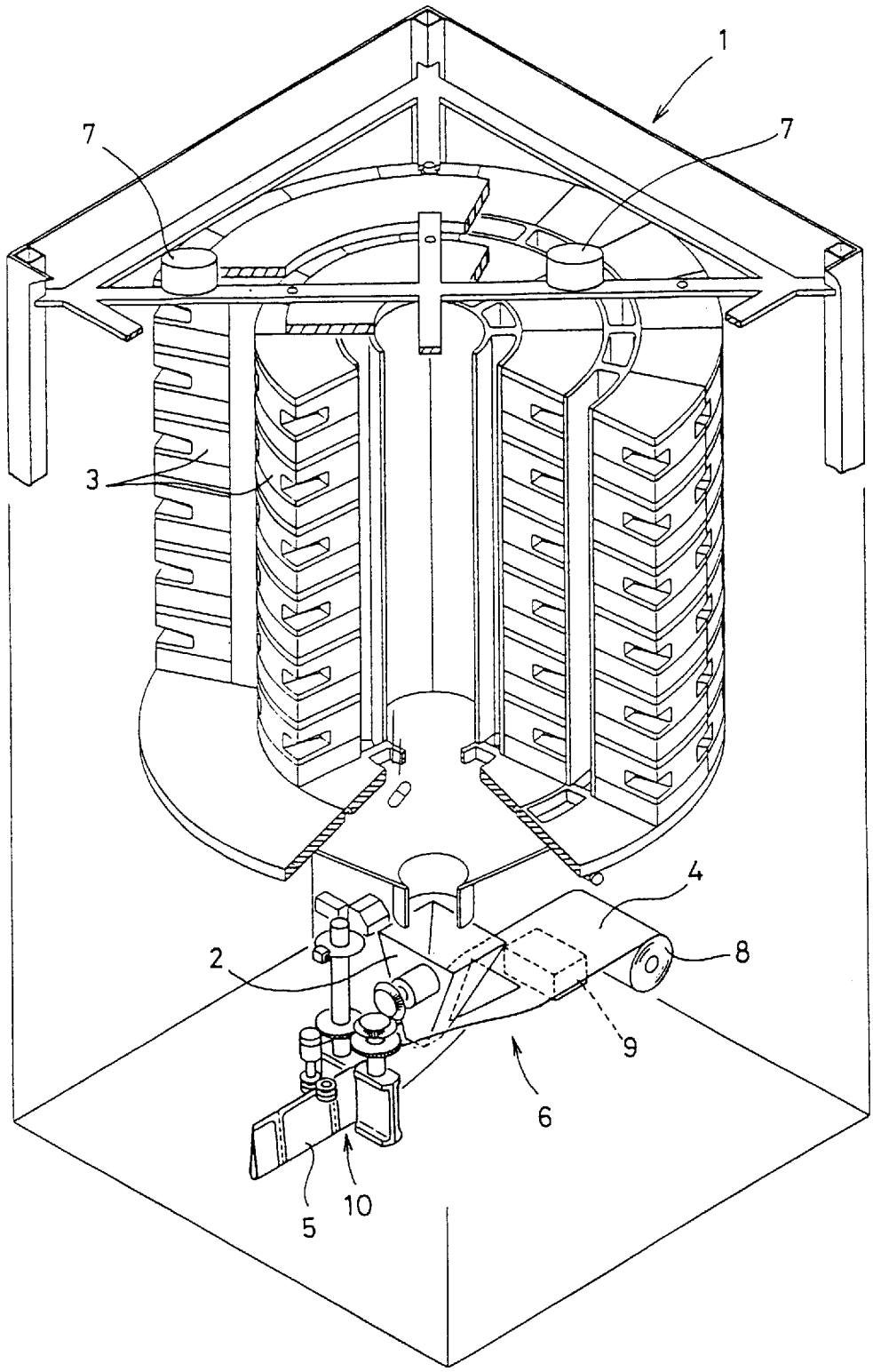
FIG. 1 is a perspective view of an embodiment of the drug packaging machine according to this invention.

Now referring to the drawings, a drug packaging machine according to this invention is described below.

The drug packaging machine 1 shown in FIG. 1 comprises a plurality of drug feeders 3 that stores different kinds of drugs, a hopper 2 provided under the feeders 3, and a drug packaging unit 6. The drug feeders 3 drop drugs according to prescription data supplied from a host computer into the hoppers 2 in the order in which the drugs are to be taken. The drugs collected in the hopper 2 are packaged in a plurality of series-connected drug bags formed by sealing a strip of web of sheet 4 by the packaging unit 6.

The feeders 3 are arranged to form an inner and an outer concentric cylindrical structures, each comprising a plurality of vertically arranged feeder rows. The two cylindrical structures are rotated separately by two motors 7.

Figure 2:
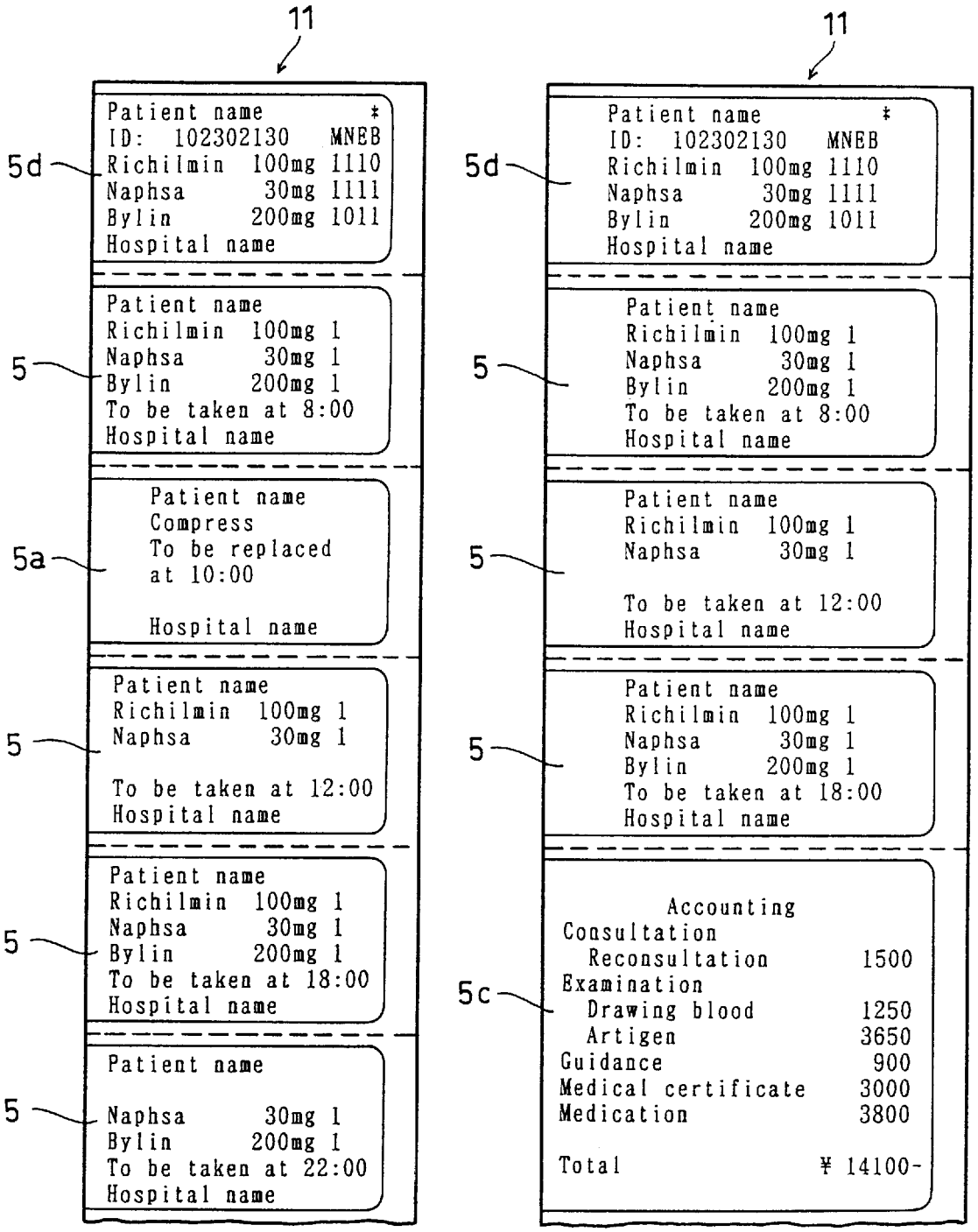
FIG. 2 is a front view of a strip of drug bags.
Figure 3:
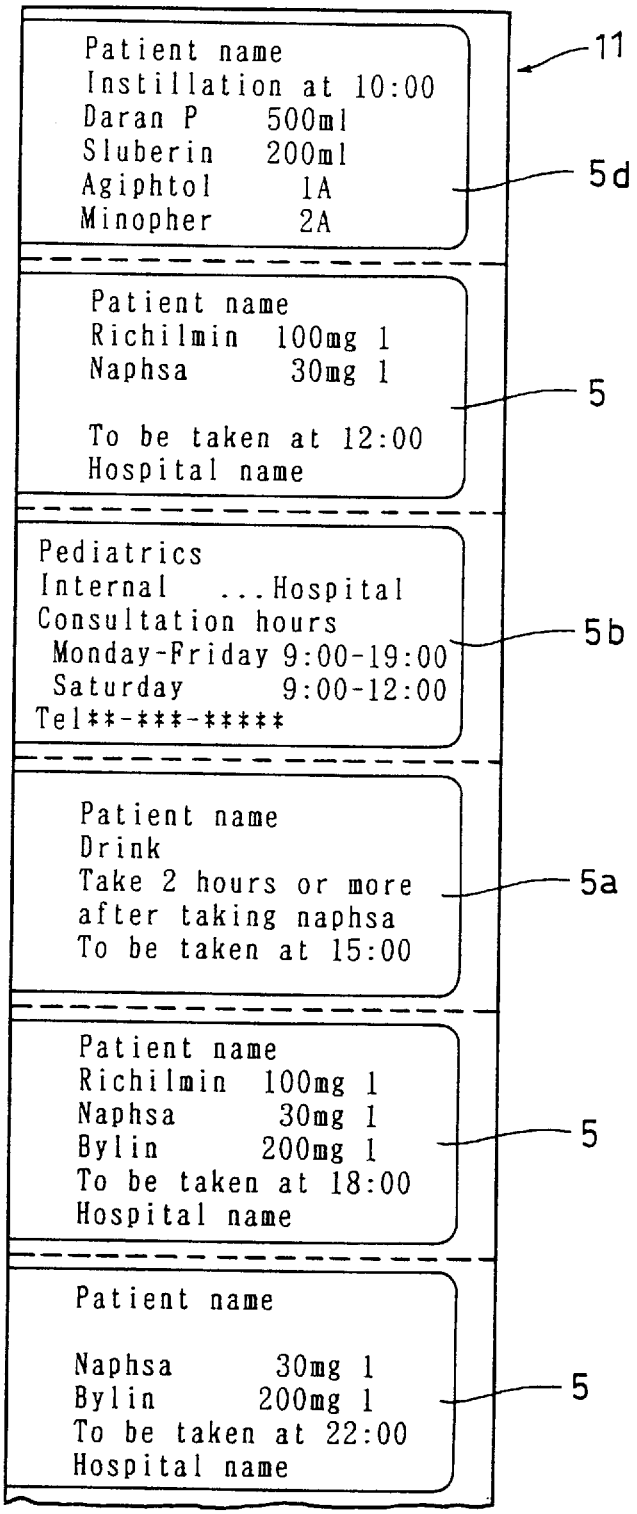
FIG. 3 is a front view of a different kind of strip of drug bags.

The packaging unit 6 has a printer 9 for printing data on the packaging sheet 4 which is fed from a sheet roll 8. The sheet 4 is folded along its longitudinal center line to define a space having a top opening. Drugs in the hopper 2 are dropped into this space. The sheet is then heat-sealed by a heat roller unit 10 to form drug bags 5 with the drugs sealed therein. As shown in FIGS. 2 and 3, a plurality of drug bags 5, series-connected in the form of a strip 11 and arranged in the order of taking, are thus formed for each patient.

As shown in FIGS. 2 and 3, the printer 9 prints drug data, taking directions, ads of the hospital, billing data, etc. on the sheet 4 at locations that will coincide with respective drug bags 5 of each strip 11 to be formed in a later stage.

On each drug bag 5 that actually contains prescribed drugs, the printer prints drug data and taking directions such as the patient's name, the kind and amount of drugs in the bag, taking time and instructions.

If a drug that cannot be put in a drug bag, such as wet packs, a liquid drug or a drug for instillation, are mentioned in a prescription, the drug packaging machine 1 forms an empty drug bag 5*a* at a position corresponding to the taking order of this particular drug, and prints necessary data about this drug on the empty drug bag 5*a*. The strip 11 thus formed is handed to the patient, who can take the drugs in the drug bags and the drugs whose data are printed on the empty drug bags one after another in the correct order of taking. Unlike conventional arrangements, data on every drug the patient has to take, including those which cannot be put in drug bags, are shown on the drug bag strip in the correct order, so that he or she can take every necessary drug without fail.

If it is desired to print hospital ads or billing data, as shown in FIGS. 2 and 3, an empty drug bag 5*b* or two are formed to print hospital ads, and a longer empty drug bag 5*c* is formed at the tail end of the strip 11 to print billing data. Since all the information necessary for a patient and a hospital is shown on a single strip, this arrangement is convenient both for the patient and the hospital. In this embodiment, an empty bag 5*d* is formed at the head of the strip 11 to print prescription data.

Figure 4:
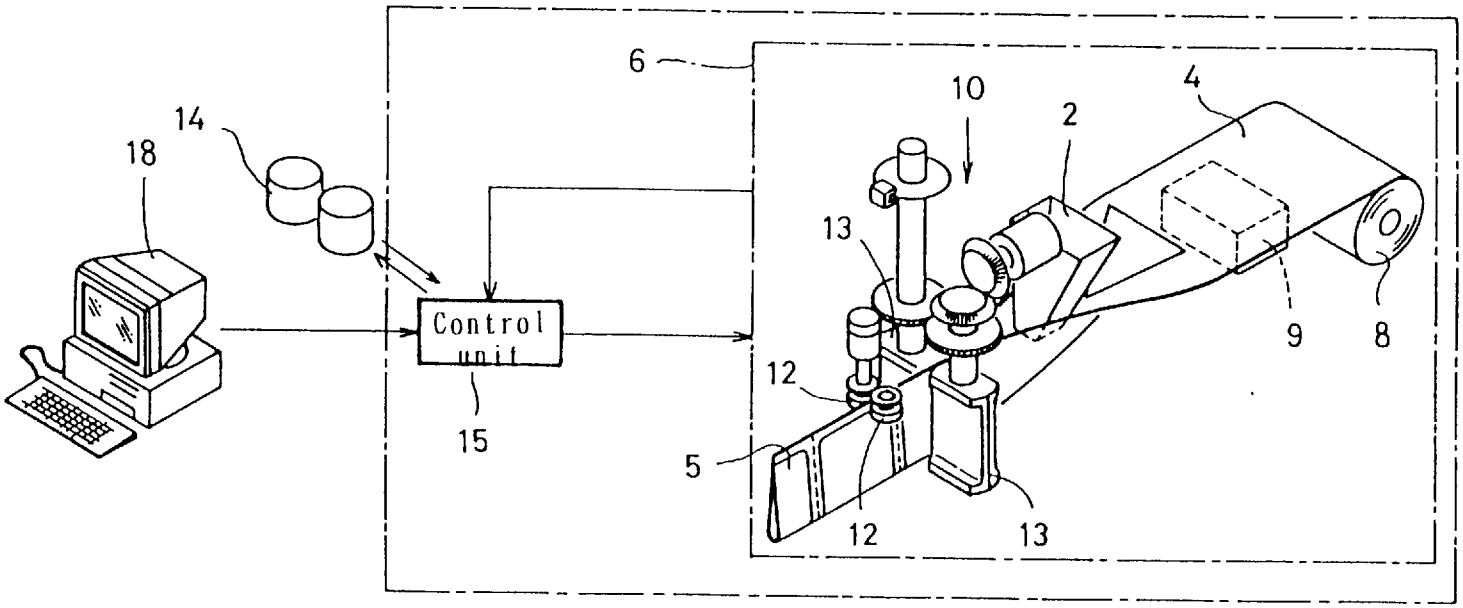
FIG. 4 is a schematic view showing a packaging unit of the drug packaging machine of FIG. 1.

Referring to FIG. 4, the heat roller unit 10 comprises a pair of transverse heat rollers 13 for heat-sealing the sheet 4 which has been folded along its longitudinal centerline, in its width direction at predetermined intervals to form open-topped bags, and a pair of longitudinal heat rollers 12 for heat-sealing the top edge of the folded sheet, i.e. the open tops of the bags formed by the heat rollers 13.

The longitudinal heat rollers 12 continuously nip and heat-seal the top edge of the folded sheet 4 while rotating.

The transverse heat rollers 13 are adapted to intermittently nip the sheet 4 to heat-seal the sheet in its width direction at predetermined intervals. The distance between adjacent transverse seal lines formed by the rollers 13, that is, the nipping timing is adjusted by the control unit 15 according to the amount of data to be printed on the bags 5, 5*a*, 5*b*, 5*c* or 5*d* defined between the adjacent transverse seal lines, which data are stored in a data base memory 14.

Figure 5:
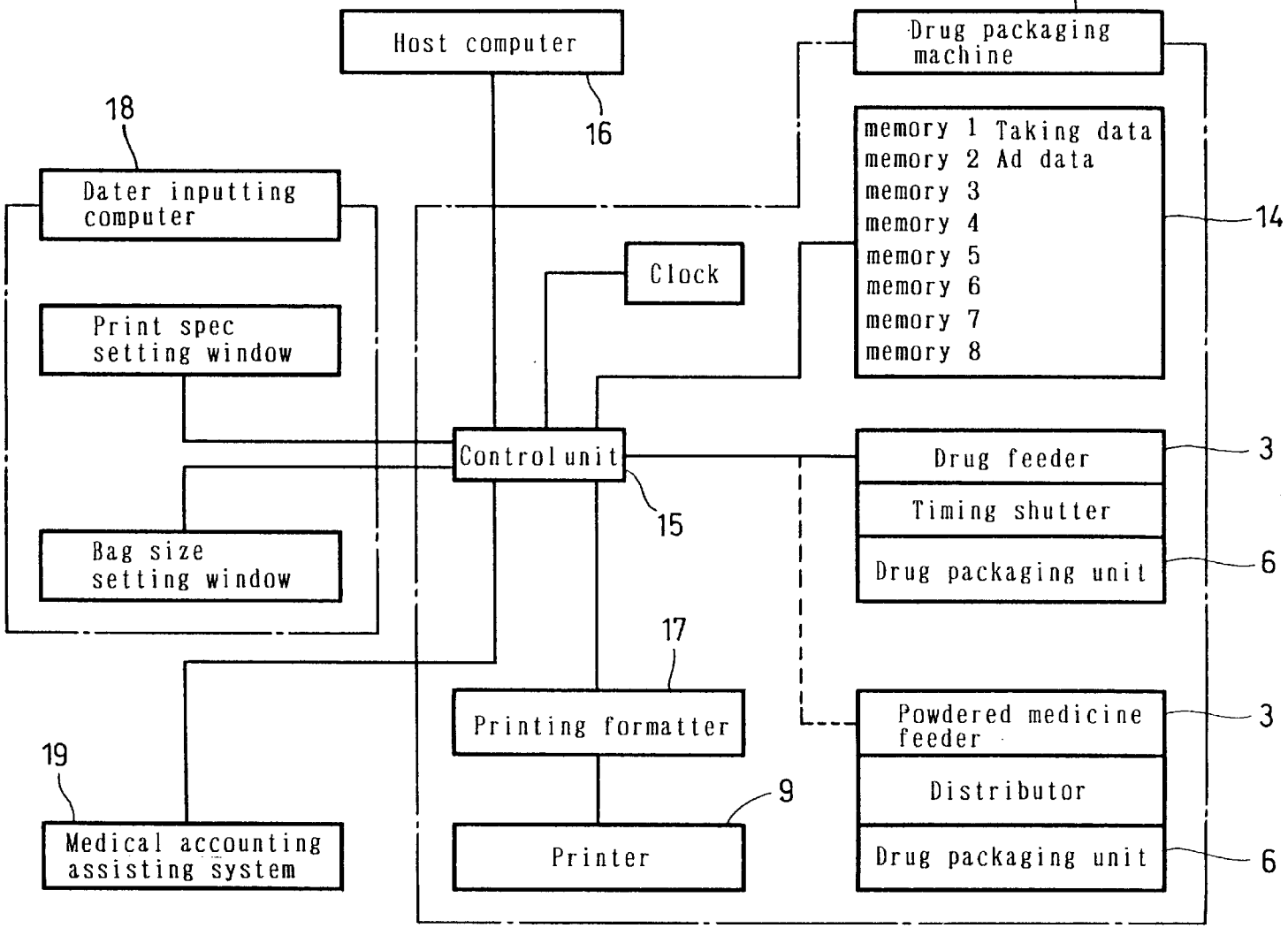
FIG. 5 is a block diagram of the drug packaging machine of FIG. 1.

As shown in FIG. 5, the control unit 15 controls, as a sequencer, drug feeders 3, including tablet and powder drug feeders, packaging unit 6 and printer 9, and also creates print data for controlling the printer 9 based on the prescription data supplied from the host computer 16 and drug taking data and advertisement data stored in the data base memory 14.

As the sequencer, the control unit 15 controls the timing of dropping drugs from selected drug feeders 3, the timing of printing data on the portions of the sheet 4 in which the drugs dropped from the feeders are to be packaged, and the timing of nipping and transversely sealing the sheet to form the bags according to the amount of data to be printed, thereby packaging drugs in bags in a smooth and coordinated manner.

Also, as the printing data creating means, the control unit 15 creates printing data by combining prescription data transferred from the host computer 16, i.e. data on names and amounts of drugs designated in a prescription for each patient and the patient's name, and data on taking directions for the designated drugs such as "to be taken one hour after every meal", which are stored in the data base memory 14. If the prescription lists a drug which cannot be put in a drug bag 5, the control unit 15 instructs the heat roller unit 10 to form an empty drug bag 5*a* at a position on the strip corresponding to the taking order of this particular drug, creates printing data on this particular drug by accessing the data base memory 14, and instructs the printer 9 to print the thus created printing data on the empty drug bag 5*a*.

The printing data are formatted to an easy-to-read form by a printing formatter 17 and printed on drug bags by the printer 9.

As shown in FIG. 5, the control unit 15 is also connected to a data inputting computer 18 and a medical accounting assisting system 19.

On the data inputting computer 18, the printing format, ad layout, its position in the strip 11 and other printing specifications, and the sizes of bags 5, 5*a*, 5*b*, 5*c* and 5*d* are set. Based on these settings, the control unit 15 controls the packaging unit 6 and other units and creates printing data.

The medical accounting assisting system 19 transfers billing data for each patient to the control unit 15. In response, the control unit 15 creates the printing data and prints on an empty drug bag 5*a* of a suitable length formed at the end of the strip 11 and prints the billing data thereon.

Figure 6:
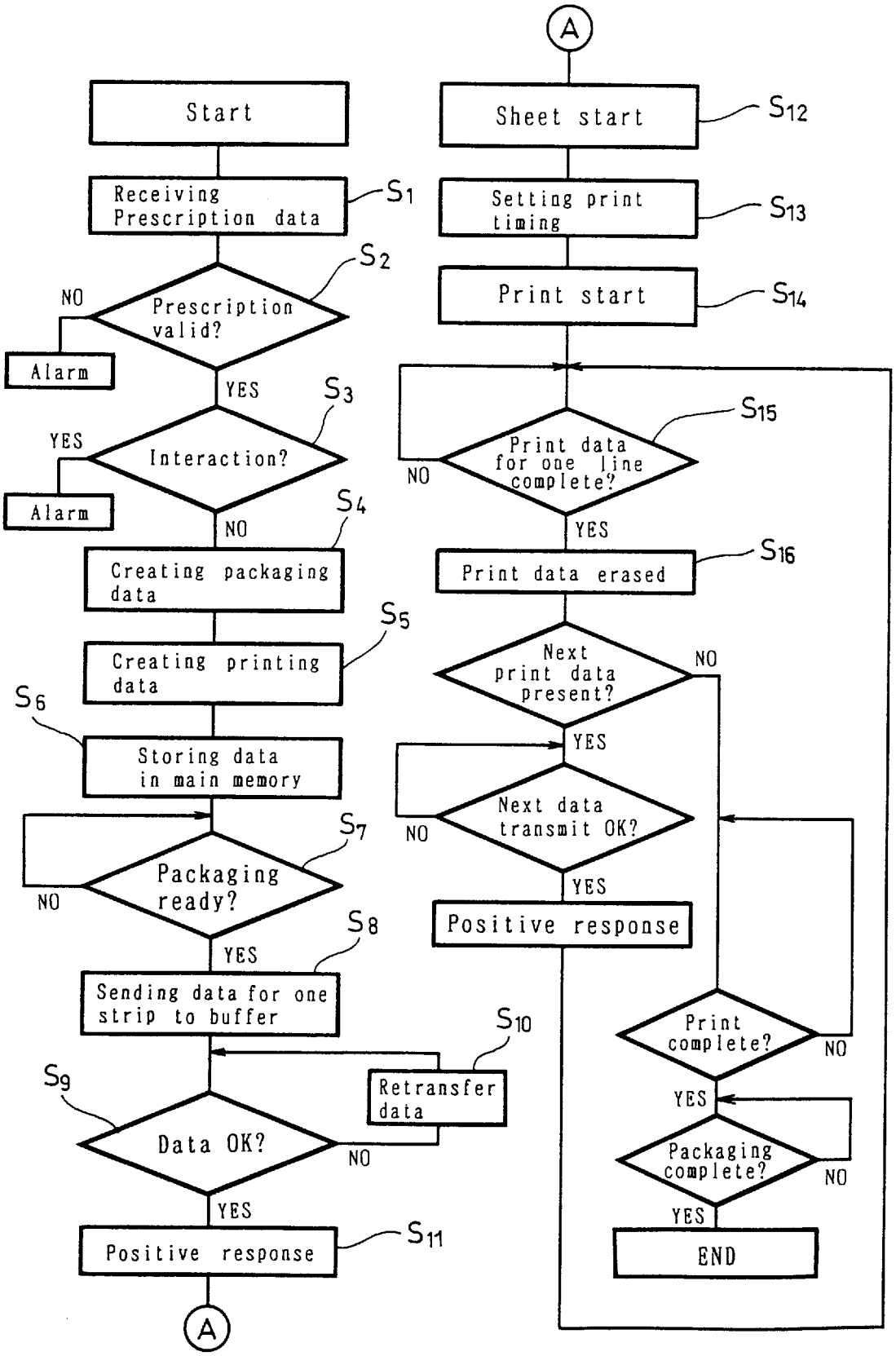
FIG. 6 is a flowchart of printing steps for a drug packaging operation.

Now referring to the flowchart of FIG. 6, a description is made of the steps of printing data and forming bags by sealing the sheet 4 in the packaging machine 1.

As shown in FIG. 6, when the control unit 15 receives prescription data from the host computer 16 (Step S1), it checks whether or not the prescription data received are valid (Step S2), and checks if there is any interactions between the prescribed drugs (Step S3). If there is anything wrong in Step S2 or S3, the control unit sounds an alarm.

Then in Step S4, the control unit 15 analyzes the data, arranges the kinds and amounts of drugs in the order of taking, checks if there is any drug which cannot be put in a drug bag, and creates packaging data.

In the following Step S5, the control unit 15 analyzes the prescription data, and creates printing data for each strip 11 based on the data on the kinds of drugs specified in the prescription, while referring to the taking directions stored in the data base memory 14, printing layout data and the data on the sizes of the drugs bags 5, 5*a*, 5*b*, 5*c* and 5*d*, which are transferred from the data inputting computer 18, and the billing data from the medical accounting assisting system 19.

Then in Step S6, the control unit 15 stores packaging data and printing data in the main memory and controls the feeders 3, packaging unit 6 and printer 9 based on these data, and in Step S7, checks if the preparation for packaging is complete. If yes, the control unit 15 transfers the printing data for one strip 11 to a buffer memory in the printer 9 (Step S8), and checks if data transfer has been successful in Step S9. If not, the data are transferred again (Step S10). If it is, the control unit waits for a positive response from the printer 9 or the formatter 17 (Step S11).

If it receives a positive response, the control unit 15 turns the sheet roll 8 to feed the sheet 4 in Step 12, sets the printing timing based on the feed speed of the sheet 4 in Step S13, and starts printing in Step S14.

Then, printing data are printed one line each in Steps S15 and S16. Printing data are erased one after another as they are printed. When the printing data stored in the buffer memory in the printer 9 have been erased completely, new printing data are transferred to the buffer memory. When all the necessary data have been printed on the strip and all the necessary drugs have been packaged for each strip, the packing is complete and the strip is ready for delivery to a patient.

Figure 7:
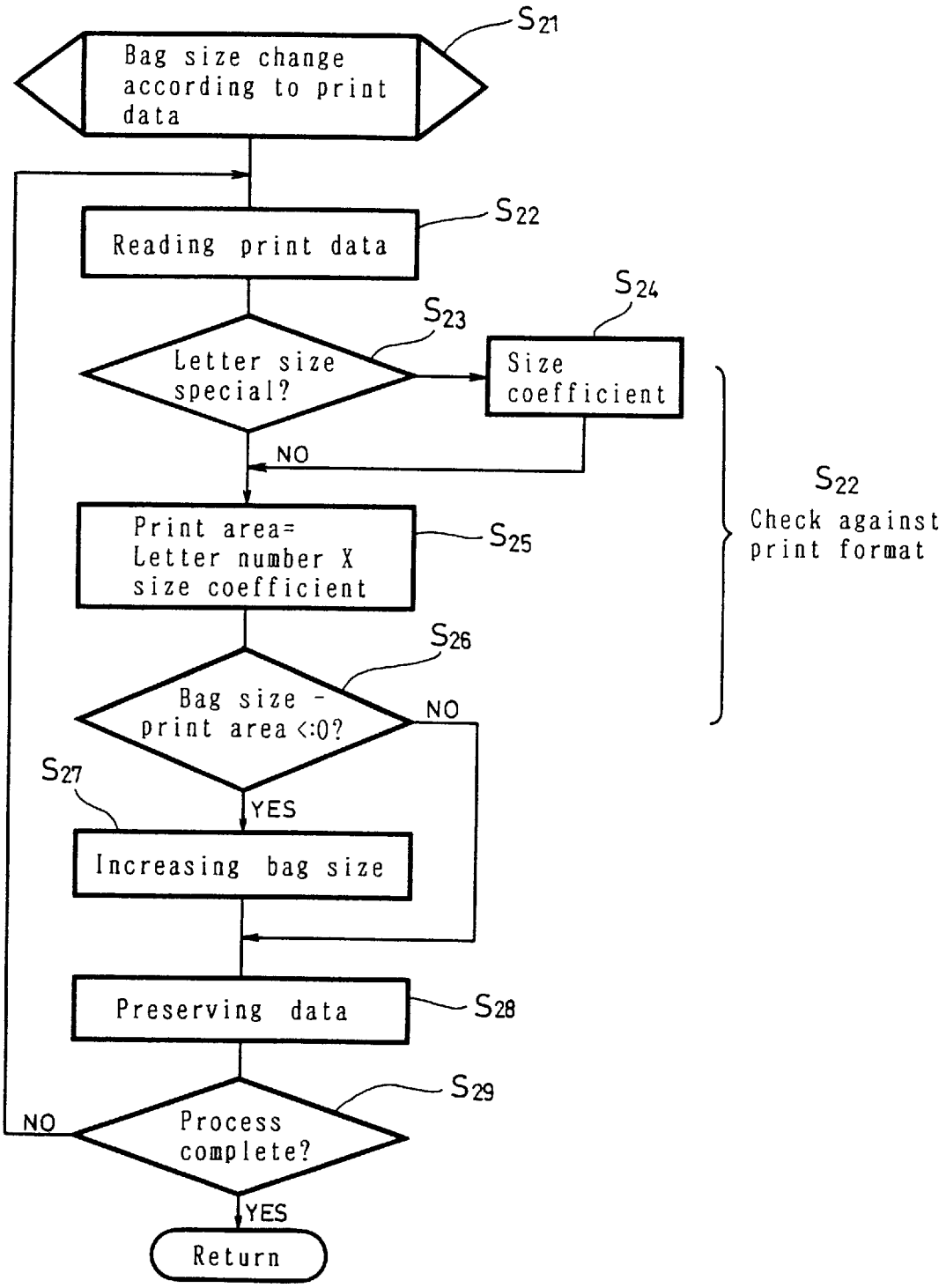
FIG. 7 is a flowchart of the packaging steps.
Figure 8:
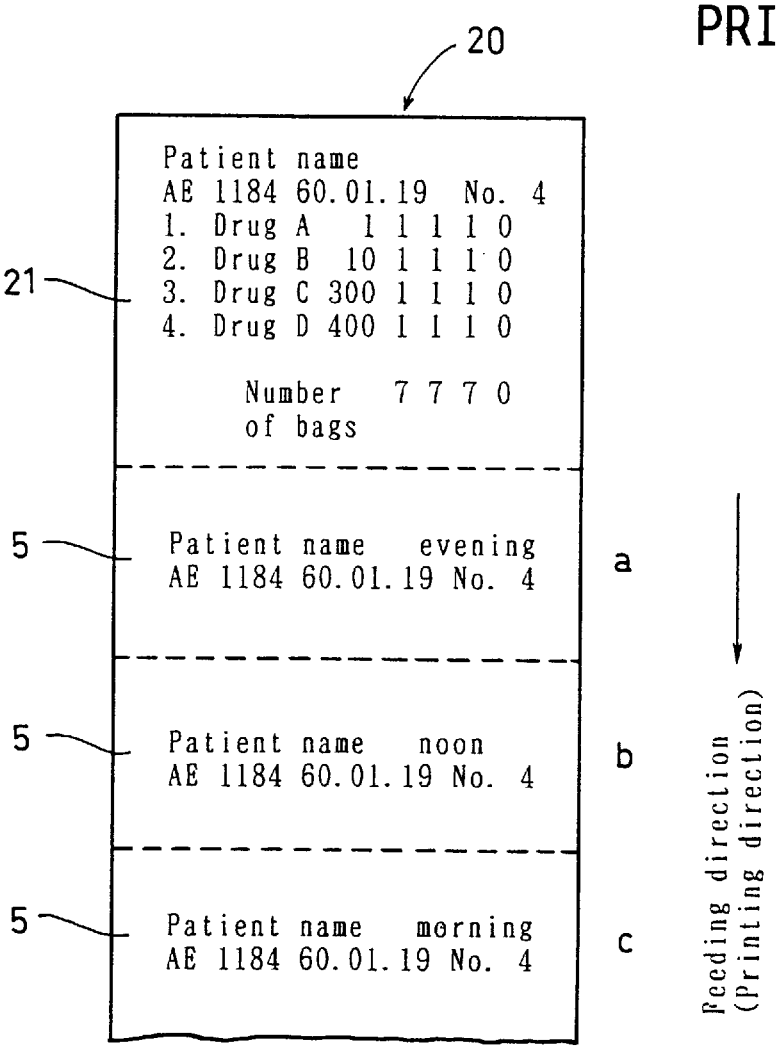
FIG. 8 PRIOR ART
FIG. 8 is a front view of a conventional drug bag.

The drug packaging machine 1 determines the sizes of bags 5, 5*a*, 5*b*, 5*c* and 5*d* according to the printing data in the following steps, as shown in FIG. 7.

First in Step S21, the control unit 15 compares the number of letters to be printed in one line with an effective width (in this embodiment, data are printed in the width direction) of a bag 5, 5*a*, 5*b*, 5*c* or 5*d* on which the printing data are to be printed, and judges if the printing data can be printed on the bag. If it is impossible to print data on a bag of the effective width, the control unit 15 prolongs the nipping timing of the transverse heat rollers 13 to prepare a bag having a greater width so that the necessary data can be printed thereon.

Specifically, the control unit 15 calculates the printing area (number of lines) by dividing the total number of letters to be printed on the particular bag by the maximum number of letters that can be printed in one line in Step S22 to S25, and compares the thus calculated printing area with the printing area of a bag of the standard width in Step S26. If the former is greater than the latter, the nipping timing of the transverse heat rollers 13 is prolonged in order to prepare a bag having a width which is greater than the standard width in Step S27. If the latter is greater, a bag of the standard width is prepared in Step S28.

In the above printing area, spaces are included between lines and in other locations so as to improve legibility of the printed data.

Further, the control unit 15 judges the letter size in Step S21, and changes, if necessary, the letter size by changing in Step S24 the coefficient of letter size to be used in Step S25.

When the width of the bag 5, 5*a*, 5*b*, 5*c* or 5*d* on which the necessary print data are to be printed has been changed, the data on the width of the bag is stored in Step S28. The above operation is repeated to prepare a strip of bags for each patient (Step S29).

Bar codes may be further printed on each bag (5, 5*a*, 5*b*, 5*c*, 5*d*) so that a computer can check and supervise the drugs to be delivered to patients by reading various data from the bar codes.

A strip of drug bags delivered to a patient contains all the necessary taking directions and schedule, so that all the patient has to do is simply take the drugs as instructed on the strip. There is nothing complicated or confusing. Also, patients can easily get other information such as billing data and information on the hospital in general whenever they need such information, because such information is printed on their drug bags.

What is claimed is:

1. A drug packaging machine comprising:

means for forming a plurality of bags in series from a packaging sheet;

a distinguishing means for distinguishing between a first type of prescribed drugs which can be packaged in the bags and a second type of prescribed drugs which cannot be packaged in the bags;

a drug dispenser for dispensing prescribed drugs into the bags;

a printer for printing drug taking data on said bags; and a control means for controlling said dispenser and said printer in order to dispense the first type of drugs into predetermined ones of said bags in an order in which the first type of drugs are to be taken, and to form at least one empty bag at a position corresponding to the order in which said second type of drugs are to be taken by not dispensing any drug into the empty bag, to print, on said predetermined ones of said bags, drug taking data regarding said first type of drugs dispensed into each of said predetermined ones of said bags, and to print drug taking data regarding said second type of drugs on said empty bag.

2. A drug packaging machine comprising:

a bag forming device for forming a plurality of bags in series from a packaging sheet;

a drug dispenser for dispensing prescribed drugs into the bags;

a printer for printing predetermined data on the bags; and a control means for controlling said dispenser and said printer in order to dispense drugs into predetermined ones of said bags in a prescribed order of taking the drugs, to form at least one empty bag by not dispensing any drug into at least one of said bags, and to print, on said predetermined ones of said bags, drug taking data regarding the drugs in each of said predetermined ones of said bags, and to print one of an advertisement and billing data on said empty bag.

3. A method of packaging drugs in a series of connected bags in accordance with a prescription, said method comprising:

distinguishing between a first type of drugs and a second type of drugs, wherein said first type of drugs can be packaged in a bag and said second type of drugs cannot be packaged in a bag;

forming a series of connected bags from a packaging sheet, wherein said plurality of bags includes a bag corresponding to each of said first type of drugs prescribed in said prescription and a bag corresponding to each of said second type of drugs prescribed in said prescription;

dispensing, in a prescribed order of taking, said first type of drugs into each bag which corresponds to said first type of drugs such that each bag which corresponds to said second type of drugs is an empty bag; and printing drug taking data for each of said first and second types of drugs prescribed in said prescription on each of said corresponding bags.

4. The method as claimed in claim 3, further comprising heat sealing said series of bags.

* * * * *